US005205450A

United States Patent [19]

Derosier

[11] Patent Number: 5,205,450

[45] Date of Patent: Apr. 27, 1993

[54] CHILD CARRIER

[76] Inventor: Daniel P. Derosier, 715 Jonathan La., La Crescent, Minn. 55947

[21] Appl. No.: 790,858

[22] Filed: Nov. 12, 1991

[51] Int. Cl.[5] ..... A61G 1/00

[52] U.S. Cl. ..... 224/161; 224/260; 224/262; 224/270

[58] Field of Search ..... 224/158, 159, 160, 161, 224/259, 260, 261, 262, 270

[56] References Cited

U.S. PATENT DOCUMENTS

| | | | |
|---|---|---|---|
| 781,033 | 1/1905 | Sutter . | |
| 1,198,423 | 9/1916 | De Lude et al. | 224/161 |
| 1,271,176 | 7/1918 | Kureczka | 224/160 |
| 1,464,404 | 8/1923 | Blekastad . | |
| 2,409,331 | 10/1944 | Wood . | |
| 2,496,216 | 7/1946 | Kaminski . | |
| 3,968,911 | 7/1976 | Haas . | |
| 4,037,764 | 7/1977 | Almosnino et al. | 224/160 |
| 4,271,998 | 6/1981 | Ruggiano . | |
| 4,402,440 | 9/1983 | Purtzer et al. . | |
| 4,416,403 | 11/1983 | Johnson . | |
| 4,458,834 | 7/1984 | Rosen | 224/160 |
| 4,480,775 | 11/1984 | Stanford | 224/210 |
| 4,492,326 | 1/1985 | Storm . | |
| 4,746,044 | 5/1988 | Arvizu et al. | 224/161 |
| 4,778,091 | 10/1988 | Barto . | |
| 4,790,459 | 12/1988 | Moseley . | |
| 4,901,898 | 2/1990 | Colombo et al. | 224/159 |
| 4,903,873 | 2/1990 | Poole et al. | 224/160 |
| 4,986,458 | 1/1991 | Lindey | 224/160 |
| 4,993,612 | 2/1991 | Quimby, Sr. et al. | 224/160 |

FOREIGN PATENT DOCUMENTS

| | | | |
|---|---|---|---|
| 809583 | 5/1951 | Fed. Rep. of Germany | 224/161 |
| 3916370 | 11/1990 | Fed. Rep. of Germany | 224/161 |
| 934414 | 5/1948 | France | 224/261 |
| 2481093 | 10/1981 | France | 224/161 |
| 449569 | 6/1936 | United Kingdom | 224/161 |
| 678225 | 8/1952 | United Kingdom | 224/160 |

OTHER PUBLICATIONS

Baby-Carrying Made Easy, May 13, 1956, p. 14, The Sunday Star Magazine, Washington, D.C.
American Motorist Magazine, Nov. 1957, p. 18.
Toys "R" Us, 2 page ad.
Snugli Baby Carriers, 2 pg. ad.
"Heart Beat" baby carriers, Leachco, Inc., 2 pg. 1990.

*Primary Examiner*—Stephen P. Garbe
*Assistant Examiner*—Stephen Cronin
*Attorney, Agent, or Firm*—Quarles & Brady

[57] ABSTRACT

A carrier for convenient support of a child on an adult in either the facing-in or facing-away position includes a waist belt with abdominal support portion, a saddle seat that mounts to the abdominal support portion in either position, an over-the-shoulder harness that attaches at spaced locations on the front of the abdominal support portion, then crisscrosses the back and comes over the shoulder to two narrower vest support straps which clip to portions of the seat. A pocket vest slideably mounts on the vest support straps and a retaining strap laces through the abdominal support portion and the height adjustment loops on the pocket vest.

13 Claims, 6 Drawing Sheets

CHILD CARRIER

FIELD OF THE INVENTION

The invention relates carriers for assisting an adult human in carrying a child.

DESCRIPTION OF THE BACKGROUND ART

Baby carriers of various types are disclosed in the following U.S. Pat. Nos.: Sutter, No. 781,033; Blekastad, No. 1,464,404; Wood, No. 2,409,331; Kaminski, No. 2,496,216; Haas, No. 3,968,911; Ruggiano, No. 4,271,998; Purtzer, No. 4,402,440; Johnson, No. 4,416,403; Storm, No. 4,492,326; Bartow, No. 4,778,091; and Moseley, No. 4,790,459.

Recently, another type of soft baby carrier with a shoulder harness and a vest with pocket has become available. The number of baby carriers available over the years suggests that there is still a significant need for a baby carrier that offers both firm support and convenience of use.

None of the above-mentioned carriers offers both advantages of significant load-carrying capability using a shoulder harness and firm support under the child in the abdominal region of the person carrying the child.

SUMMARY OF THE INVENTION

The invention is incorporated in a child carrier having a waist belt for fastening around a waist of a person, a seat having a portion for mounting to the waist belt, a shoulder harness having a pair of first ends which are coupled at spaced apart locations to the waist belt and having a pair of second ends extending down in front of the person for coupling to a portion of the seat extending away from the person.

The child carrier is advantageously provided with a seat that can be pivoted upward from a position in which the seat is mounted at one end to a pivot support.

In a further aspect of the invention, a lateral retaining strap or child "seat belt" is laced through the front portion of the waist belt and through a vest, the strap having opposite ends and a snap buckle for fastening the opposite ends.

In a further aspect of the invention, the seat is provided with the necessary attachment points to permit the seat to be reversed for carrying the child in either the facing-in or facing-away position.

The seat may be molded in a saddle shape for greatest utility in the above-described carrier.

Additional features of the vest are a pocket, height adjustment loops for receiving the lateral retaining strap and Velcro TM fastening strips for preventing the vest from sliding up and down on the front straps of the shoulder harness.

Other objects and advantages, besides those discussed above, will be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

DETAILED DESCRIPTION OF THE PREFERRED EMBODIMENT

Figure 1:
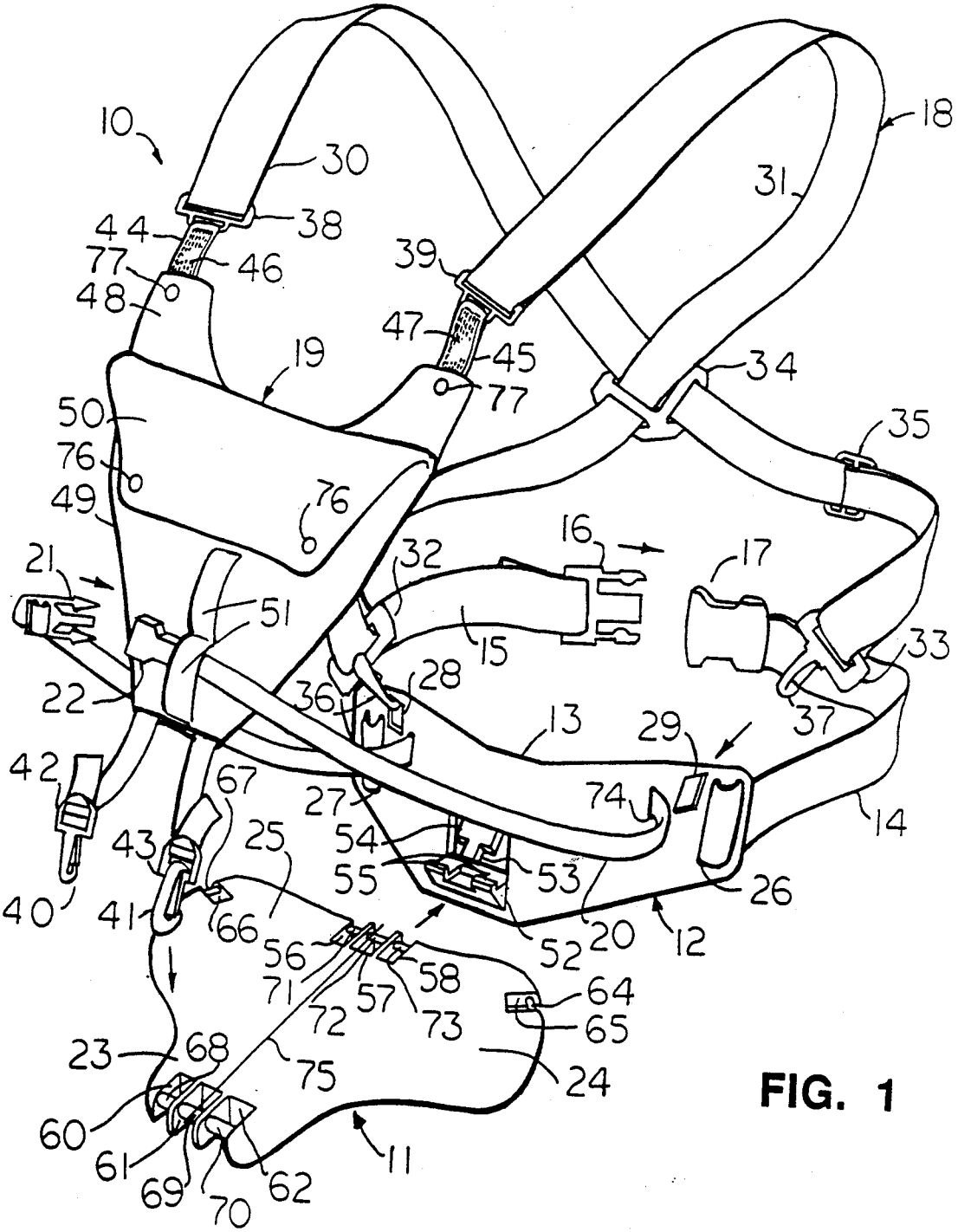
FIG. 1 is a perspective exploded view of the child carrier of the present invention with the seat in the facing-away position.

Referring to FIG. 1, the invention is incorporated in a child carrier 10 which includes a seat 11, a waist belt assembly 12 with a front portion 13, waist belt straps 14, 15 and snap-buckle assembly 16, 17, a shoulder harness 18, a vest 19 and a lateral support strap 20 and snap-buckle assembly 21, 22. The lateral support strap 20, also referred to as the "seat belt", is laced through slits 74 in the front portion of the belt assembly 13 and through the vest 19 and connected by snap-buckle assembly 21, 22.

The seat 11 is formed of a pliable seat, which is molded from a plastic material, preferably in the saddle shape, with a forwardly projecting horn 23 and lateral portions 24, 25 extending behind and laterally to the sides of the horn 23.

The front portion 13 of the waist belt assembly 12 is also formed of a pliable, plastic material.

The above-described carrier 10 is intended by wear by a person, including an adult or responsible teenager, for the purpose of carrying a young child. As used herein, the term "child" should be understood to include the term "baby".

Belt straps 14, 15, preferably of polypropylene material two inches in width extend through double slits 26, 27 in the front portion 13 of the belt assembly 12, and are secured inside of portion 13. The straps 14, 15 extend around the waist of a person to a forked connecting piece 16 with barbed, flexible projections and receiving member 17 which mate to form a snap-in and snap-apart connector.

The front portion 13 also includes openings 28, 29 formed at spaced apart locations across the front of the waist for purposes of connecting the harness 18 as will be described further below.

The harness 18 includes over-the-shoulder straps 30 and 31. These crisscross across the back of the wearer and are drawn through crossover slide member 34. The lower ends of straps 30 and 31 are looped through loop members 32, 33 and snap-on clip members 36, 37 are retained on swivel loop members 32, 33. A slide 35 for adjusting the length of strap 30 is illustrated and a similar slide (not shown) is provided for strap 31 to adjust the harness for wearers of different height and build. The upper ends of straps 30, 31 extend over the shoulders to double-loop members 38, 39 which connect two-inch straps 30, 31 to one-inch straps 44, 45. The one-inch straps 44, 45, have one-inch swivel loop/lock members 42, 43 attached at their lower ends for retaining snap-on clip members 40, 41.

Figure 2:
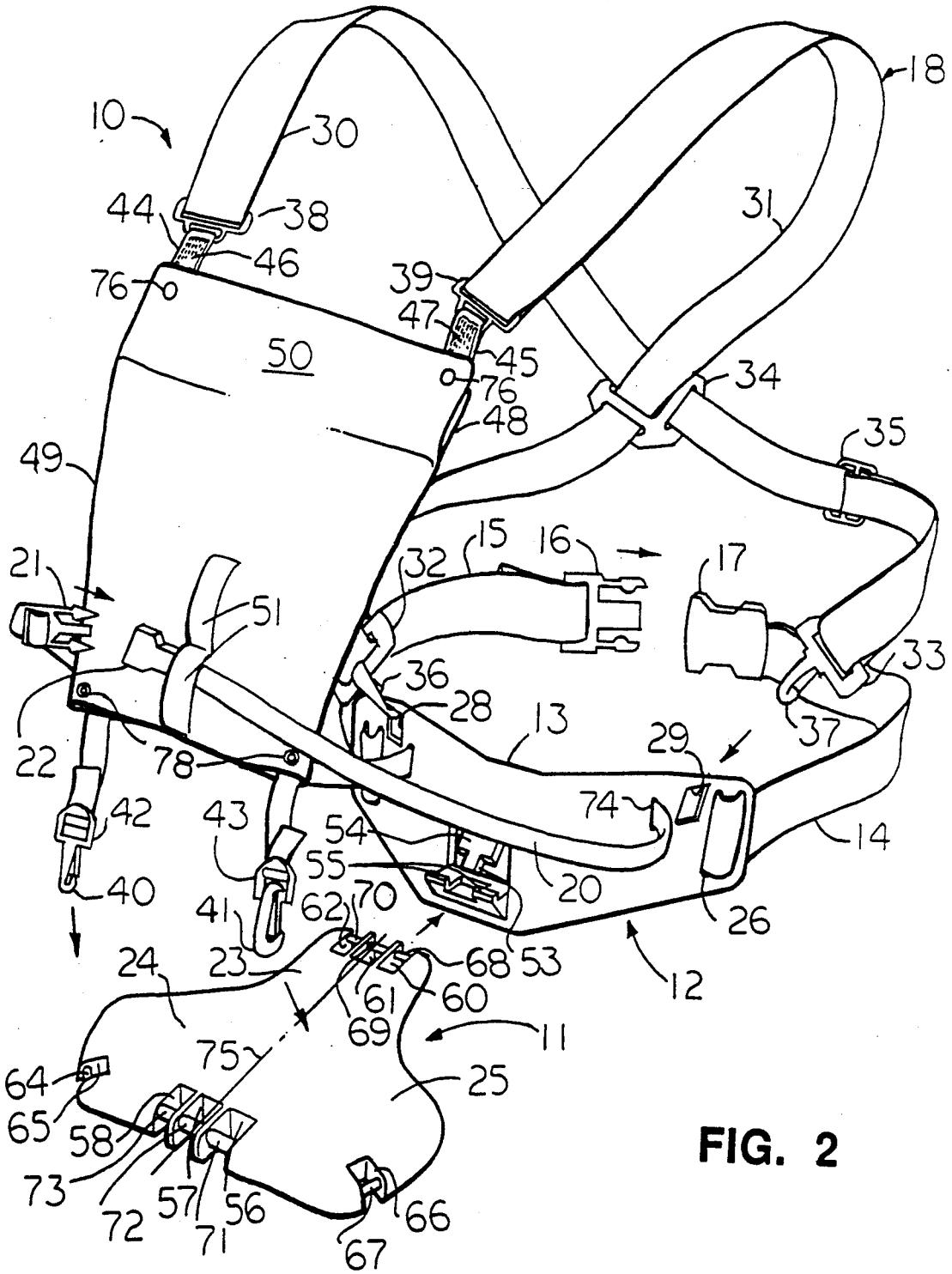
FIG. 2 is a perspective exploded view of the child carrier of FIG. 1 with the seat in the facing-in position.

The one-inch straps pass from loop members 38, 39 through passages formed in a body portion 48 of the vest 19 to loop-lock members 42, 43. The vest body 48 tapers from wide to narrow as it extends down the front of the wearer. Snaps 78 illustrated in FIG. 2, are fastened together behind straps 44, 45 to cause the vest body 48 to taper as seen in FIG. 1, where the snaps 78 are hidden from view. A pocket 49 is formed on the front of the vest body 48, with a flap 50. The flap 50 is held closed with a Velcro TM strip (not shown).

Velcro TM strips are also attached to the face of one-inch straps 44, 45 with mating portions within the vest so as to prevent the vest 19 from sliding up and down the straps 44, 45, except when manipulated by the wearer. Velcro TM strips may alternatively be attached to the face of the two-inch straps 30, 31.

Height adjustment loops 51 are oriented up and down the middle of the front of the vest 19 to receive seat belt 20 which is laced through one of the loops 51 before mating pieces 21, 22 of a snap assembly are fastened together.

The seat 11 includes three notches 60, 61, 62 at a front end of the horn 23 and three notches 56, 57, 58 to the rear of the seat 11 and opposite the notches 60, 61, 62 at the front end of the horn 23. Laterally extending pins 71, 72, 73 are positioned in the three notches 56, 57, 58 to the rear for forming a pivotal coupling with the support 52 on the front portion 13 of the belt assembly 12, and laterally extending pins 68, 69, 70 are positioned within the notches 60, 61, 62 at the front end of the horn 23 for coupling to the clip members 40, 41 on the vest support straps 44, 45.

The seat 11 also includes two notches 65, 66 oppositely disposed on the two portions 24, 25 extending behind and laterally to the sides of the horn portion 23 and includes a pin 67, 64 extending laterally within each of the two notches 65, 66 for coupling of respective second straps 44, 45 when the front end of the horn 23 is pivotally supported on the front portion 13 of the belt assembly 12.

The support 52 on the front portion 13 of the belt assembly 13 includes spaced apart lower portions 55 with upturned ends for extending under the pins 71, 73 within two spaced apart notches 56, 58 of the seat 11 and a retaining lever with downwardly extending upper portion 54 and narrower extension 53 which projects behind the pin 72 in a notch 57 between the two spaced apart notches 56, 58 to hold the seat 11 on the lower portions 55 when the seat 11 is pivoted upward.

As seen in FIG. 2, the saddle-shaped seat 11 can be reversed in position to support the child in a facing-in position. In this position, pins 68, 69, 70 are held on pivot mounting 52 and clips 40, 41 are coupled to pins 64, 67 in notches 65, 66.

FIGS. 1 and 2 illustrate the structure of carrier 10, while FIGS. 3 to 8 illustrate its use, and therefore FIGS. 1 and 2 are relied on to show the full structural details of carrier seen in FIGS. 3 to 8. The following description is for purposes of providing an example of use and operation of the invention only, and shall not be substituted for, or construed as, instructions for use of any child carrier product offered in the commercial marketplace.

Figure 3:
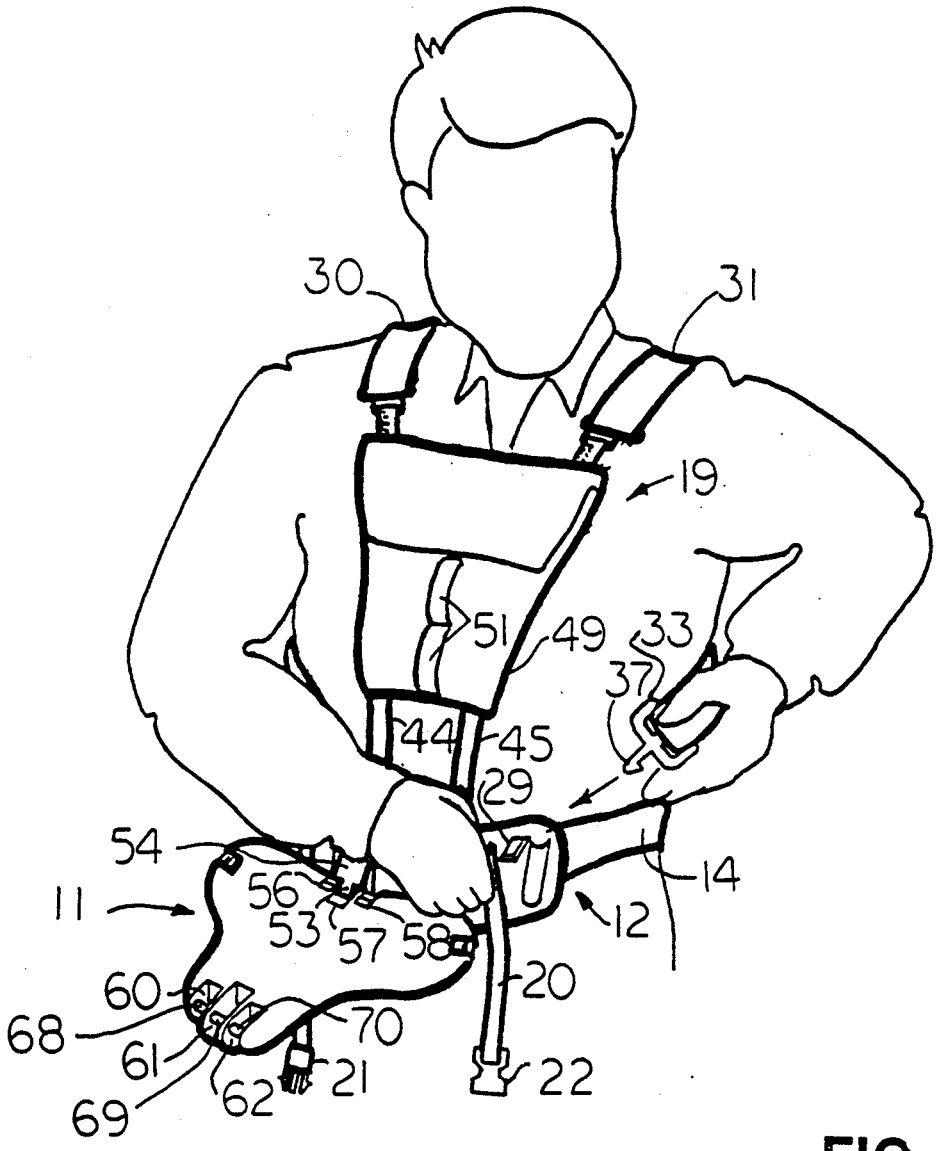
FIG. 3 is a perspective view of a person putting on the child carrier of FIG. 1 in the facing-away position.

FIG. 3 shows an example of putting on the carrier, the waist belt assembly 12 having been first fastened around the waist of an adult with the seat belt 20 laced through front portion 13. The molded seat 11 is snapped into pivotal mounting 52 on the front portion 13 of the waist belt assembly 12 and rests on the two outside pins 71, 73 in a generally horizontal position and at an angle perpendicular to portion 13. The seat's middle pin 72 is used by the retaining lever 54, 53 of the buckle to hold the seat in place and restrict the seat from pivoting downward. The seat is free to rotate upward toward the adult to angle the seat 11 slightly and keep the child positioned next to the adult. The surface of the seat 11 is pliable for comfort of the child, but the seat 11 is substantially non-bendable along an axis of symmetry 75 through the horn 23 so as to support the child.

The harness straps 30-31 have been placed over the head of the adult and onto the shoulders. The clip members 36, 37 on the two-inch straps 30, 31 come around the sides of the wearer in FIG. 4 and couple to respective openings 28, 29 in the front portion of waist belt assembly 13. The front clips 40, 41 on the one-inch front straps 44, 45 of the harness 18 are attached to the pins in the two outside notches of horn 23. In use, the straps 44 and 45 may be adjusted by pulling ends extending through elements 42 and 43 to slightly lift the seat 11 off of the resting position to some angle above perpendicular to portion 13. This adjustability feature allows fine adjustment of the carrier 10 for use by wearers of various heights.

Figure 4:
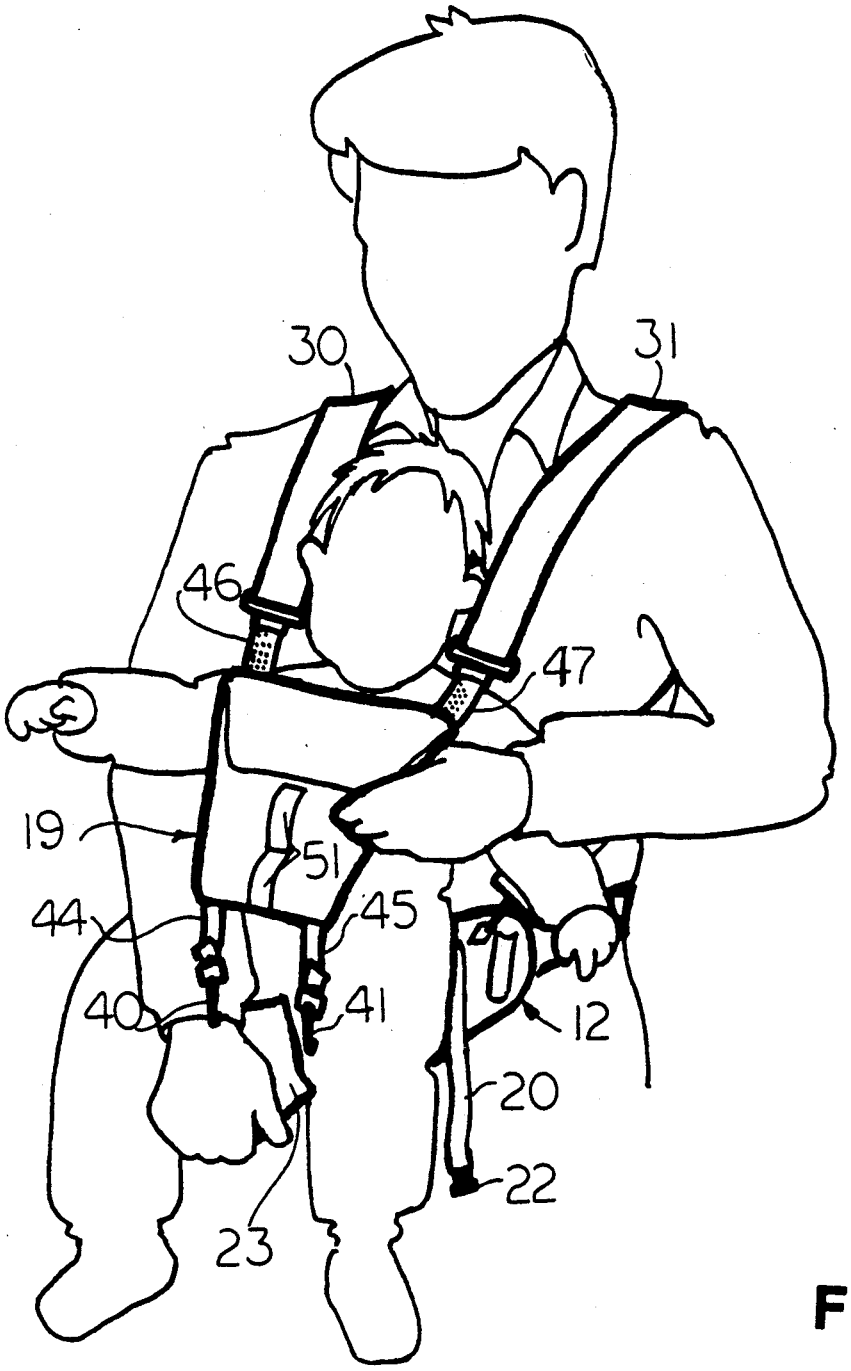
FIG. 4 is a perspective view which illustrates placing a child on the seat of the child carrier FIG. 3.
Figure 5:
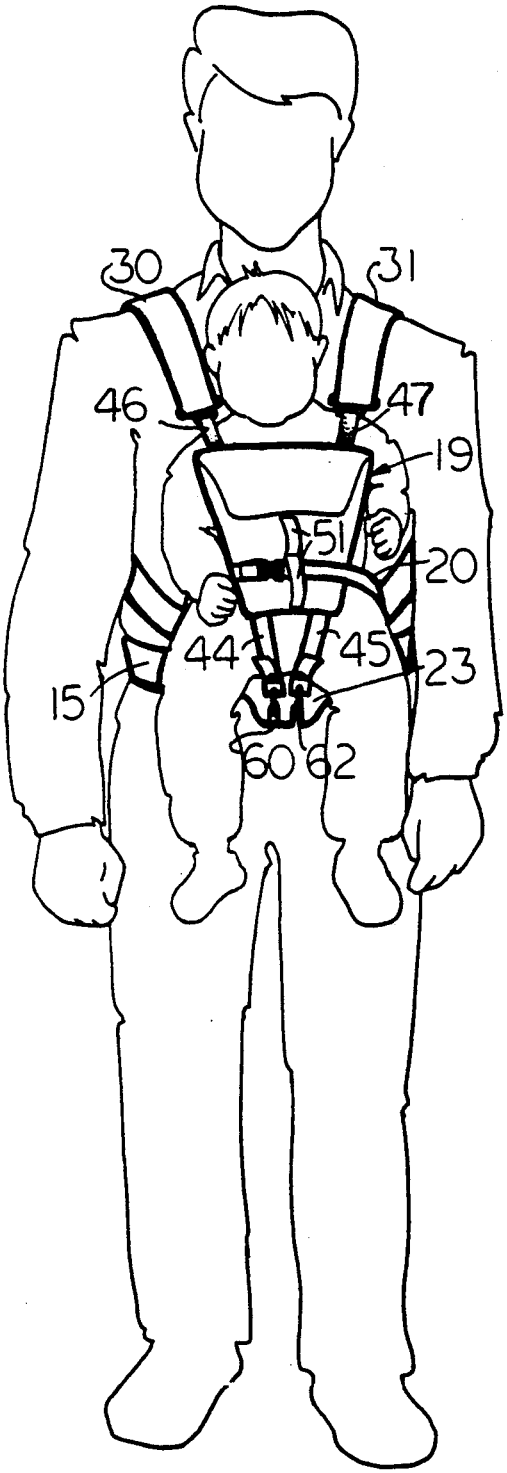
FIG. 5 is a front view of the child carrier of FIG. 4 with the child secured in the facing-away position.
Figure 6:
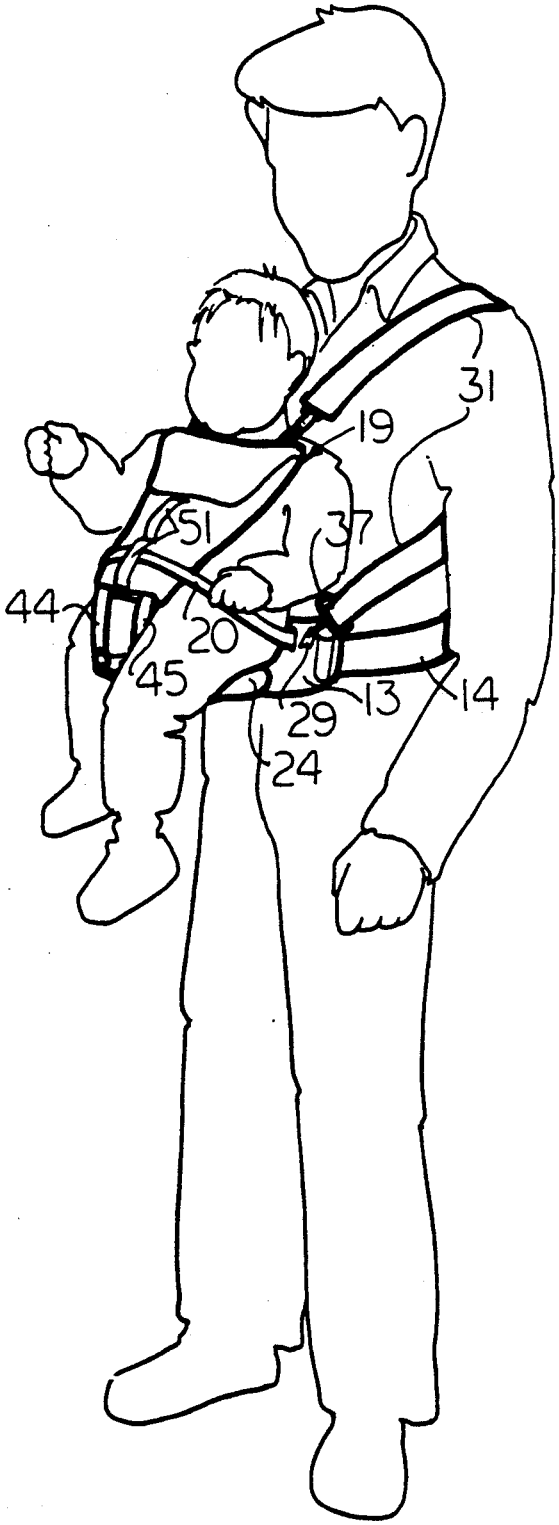
FIG. 6 is a perspective view of the child carrier of FIG. 5.

As seen in FIG. 4, to place the child on the seat 11, unsnap the front harness clips 40, 41 and lift the vest 19 and straps 44, 45 up from the molded seat 11. While holding the seat horn 23, place the child on the seat 11. The seat 11 and the child are in the facing away position in the example in FIG. 4. Once the child is situated, put the vest 19 and straps 44, 45 back over the head of the child and reattach the clips 40, 41 to horn 23 as seen in FIGS. 5 and 6. If required, reposition the vest 19 on the straps 44, 45 with the Velcro strips 46, 47 so that the vest 19 is comfortably positioned on the child's chest or back and under the neck. Position the seat belt 20 around the child and the vest 19 and slip the ends through a loop 51 in the middle of the vest 19 as seen in FIGS. 5 and 6. Tighten as required to protect the child but remain comfortable.

To remove the child, reverse the process by following these steps. Grasp the seat horn 23, and then unbuckle the seat belt 20 and remove the ends from the vest loop 51. While still holding the seat horn 23, unclip the left front clip 41 from the front of the seat 11. Hold the seat 11 and the child with your left hand. Remove the right front clip 40 and lift the straps 44, 45 and vest assembly 19 over the head of the child. Lift the child off the seat 11. To remove the seat 11 from the front portion 13, the extending end of the seat 11 is rotated upward relative to a horizontal pivot axis through the support 52. The portions of the seat 11 around the middle notch 57 will eventually contact and depress the upper portion of the retaining lever 54. Unsnap the two lower clips 36, 37 from the molded front portion 13 Unsnap the waist belt buckle 16, 17 behind the back. Place the waist belt assembly 12, shoulder harness 18, and the seat 11 into the vest pocket 49 and close flap 50 to use vest 19 as a tote bag.

Figure 7:
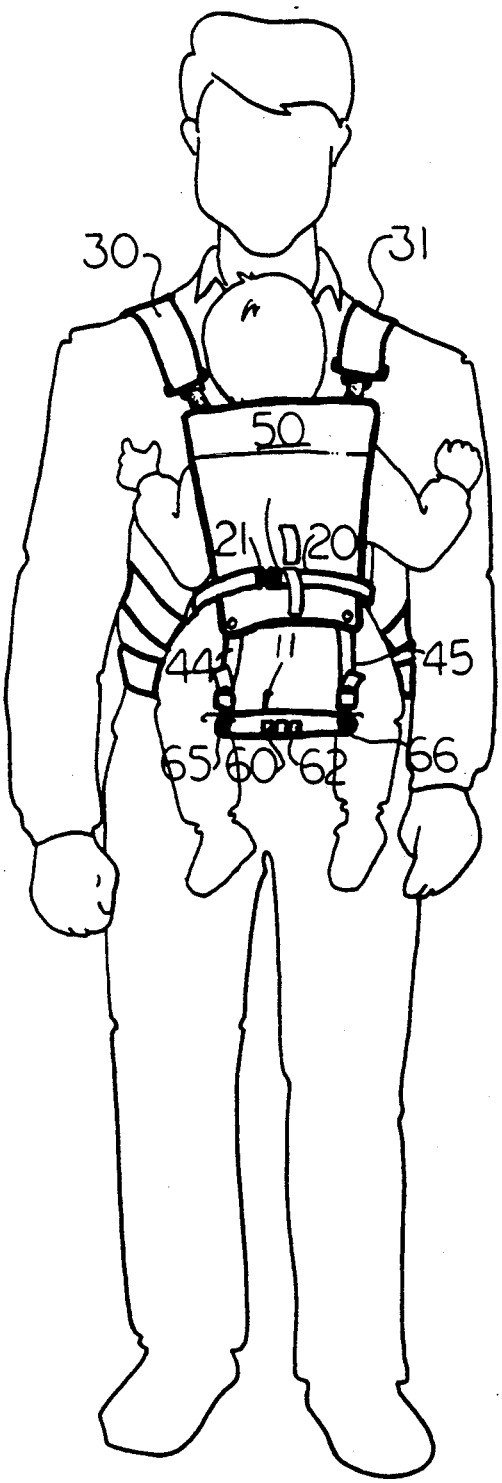
FIG. 7 is a front view of the child carrier of FIG. 2 with the child secured in the facing-in position.
Figure 8:
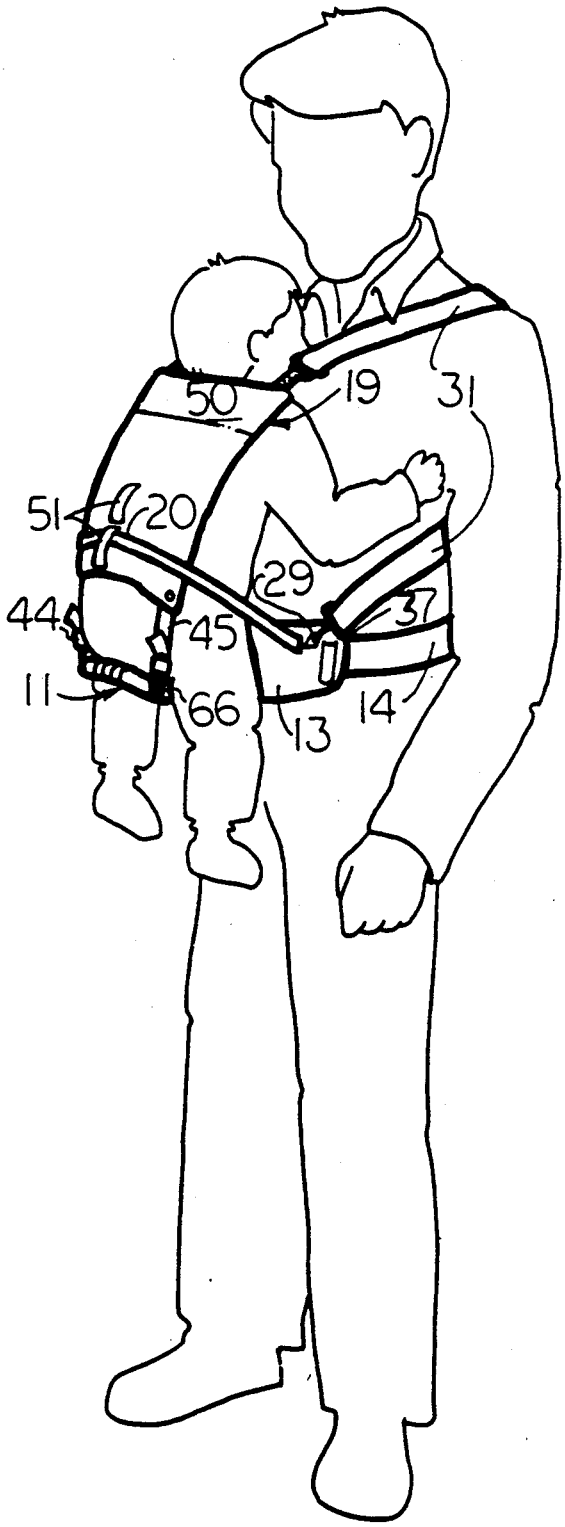
FIG. 8 is a perspective view of the child carrier of FIG. 7.

The procedure is the same for placing the child on the seat, or removing the child from the seat 11, when the seat 11 is in the reverse position, as seen in FIGS. 2, 7 and 8.

If the child is in the facing-in position, the pocket flap 50 is available to further protect the child's head. The flap 50 may be lifted upward and attached with snap fasteners 76 to mating parts 77 on vest body 48.

This description has been by way of example of how the invention can be carried out. Those of ordinary skill in the art will recognize that various details may be modified in arriving at other detailed embodiments, and that many of these embodiments will come within the scope of the invention.

Therefore, to apprise the public of the scope of the invention and the embodiments covered by the invention, the following claims are made.

I claim:

1. A carrier for a child comprising:

belt means for fastening around a waist of a person, the belt means including a front portion extending across a front of the waist, the front portion having a support thereon;

a seat having a portion for mounting to the support;

a shoulder harness that extends over the shoulders and along sides of the person and having a pair of first ends which are coupled at spaced apart locations to the belt means and having a pair of second ends extending down in front of the person for coupling to a portion of the seat extending away from the person;

wherein the support and the portion of the seat for mounting to the support are formed such that the seat is releasably detached from the support by pivoting the seat upward relative to the support, but such that the seat is secured to the support and restricted from pivoting downward from the position in which the seat mounts on the support.

2. The carrier of claim 1, further comprising a retaining strap laced through the front portion of the belt means for retaining the child laterally in the seat, the strap having opposite ends and means for fastening the opposite ends.

3. The carrier of claim 2, further comprising a vest extending between the second ends of the shoulder harness for holding the child on the seat and towards the front of the person; and wherein the vest includes height adjustment loops oriented up and down along a front of the vest, and wherein the retaining strap passes through one of the belt adjustment loops and around the vest.

4. The carrier of claim 3, wherein the vest forms a pocket and includes a flap for covering a back portion of the child's head, when the child is in the facing-in position.

5. The carrier of claim 1, wherein:

the seat has a saddle shape with a horn extending forward in one direction and with two portions extending behind and laterally to the sides of the horn portion.

6. The carrier of claim 5, wherein the seat includes at least two notches at a front end of the horn and three notches to the rear of the seat and opposite the two notches at the front end of the horn, laterally extending pins positioned in the three notches to the rear for forming a pivotal coupling with the support on the front portion of the belt means, and laterally extending pins positioned within the notches at the front end of the horn for coupling of the second pair of ends.

7. The carrier of claim 5, wherein the seat forms three notches at a front end of the horn and includes a laterally extending pin in each notch for forming a pivotal coupling with the support on the belt means, and wherein the seat forms two notches oppositely positioned on the two portions extending behind and laterally to the sides of the horn portion, the two notches each including a pin extending laterally within the notch for coupling of a respective second end of the harness when the front end of the horn is pivotally supported on the front portion of the belt means.

8. The carrier of claim 5, wherein the support on the front portion of the belt means includes spaced apart lower portions with upturned ends for extending under the pins within two spaced apart notches of the seat and a downwardly extending upper portion which projects behind the pin in a notch between the two spaced apart notches to hold the seat on the lower portions when the seat is pivoted upward.

9. A carrier for a child comprising:

belt means for fastening around a waist of a person, the belt means including a front portion extending across a front of the waist, the front portion having a support thereon;

a seat having a portion for mounting to the support;

a shoulder harness that extends over the shoulders and along sides of the person and having a pair of first ends which are coupled at spaced apart locations to the belt means and having a pair of second ends extending down in front of the person for coupling to a portion of the seat extending away from the person;

wherein the seat has a near end and an opposite end and wherein the ends of the seat can be reversed in position relative to the support;

wherein the opposite end of the seat includes means for mounting to the support on the belt means; and wherein the near end of the seat also include means for mounting to the support on the belt means and also includes means for coupling to the second straps when the opposite end is mounted to the front portion the belt means.

10. The carrier of claim 9, wherein the seat is formed along an axis of symmetry and is substantially non-bendable along such axis to support a child.

11. The carrier of claim 9, wherein the front portion has openings disposed laterally to opposite sides of locations where the second strap ends couple to the portion of the seat extending away from the person.

12. A carrier for a child comprising:

belt means for fastening around a waist of a person, the belt means including a front portion extending across a front of the waist, the front portion having a support thereon;

a seat having a portion for mounting to the support;

a shoulder harness that extends over the shoulders and along sides of the person and having a pair of first ends which are coupled at spaced apart locations to the belt means and having a pair of second ends extending down in front of the person for coupling to a portion of the seat extending away from the person; wherein the shoulder harness comprises:

a crossover slide;

two over-the-shoulder straps which extend through the slide and across a back of the person to the first ends of the harness;

two vest support straps which are narrower in width than the over-the-shoulder straps and which extend from upper ends to the second ends of the harness;

means for connecting the upper ends of the two vest support straps to the two over-the-shoulder straps; and wherein the child carrier further comprises a vest extending between the two vest support straps for holding the child on the seat and towards the front of the person.

13. The carrier of claim 12, further comprising means on the vest support straps and on the vest for limiting the sliding of the vest on the vest support straps.

* * * * *